US007679525B2

(12) United States Patent
Nielsen

(10) Patent No.: US 7,679,525 B2
(45) Date of Patent: Mar. 16, 2010

(54) REMOTE CONTROL DEVICE AND METHOD OF CONFIGURATION OF SUCH A REMOTE CONTROL DEVICE

(75) Inventor: Martin S. Nielsen, Nørre Nebel (DK)

(73) Assignee: VKR Holding A/S (DK)

( * ) Notice: Subject to any disclaimer, the term of this patent is extended or adjusted under 35 U.S.C. 154(b) by 843 days.

(21) Appl. No.: 10/433,216

(22) PCT Filed: Dec. 5, 2001

(86) PCT No.: PCT/DK01/00807

§ 371 (c)(1),
(2), (4) Date: Nov. 12, 2003

(87) PCT Pub. No.: WO02/47038

PCT Pub. Date: Jun. 13, 2002

(65) Prior Publication Data

US 2004/0070516 A1 Apr. 15, 2004

(30) Foreign Application Priority Data

Dec. 10, 2000 (DK) ..... 2000 01848

(51) Int. Cl.
*G08C 19/00* (2006.01)

(52) U.S. Cl. ..... 340/825.72; 340/825.69; 340/5.22; 340/5.23; 340/5.61

(58) Field of Classification Search ..... 340/825.72, 340/825.14, 825.65, 825.67, 5.4, 5.11, 5.32, 340/825.69, 5.22, 5.23, 5.24, 5.25, 5.26, 340/5.61, 5.62, 5.63, 5.64, 5.7, 5.71, 5.72; 375/364, 365; 455/562; 380/9; 70/278
See application file for complete search history.

(56) References Cited

U.S. PATENT DOCUMENTS 5,148,159 A 9/1992 Clark et al.
5,343,529 A * 8/1994 Goldfine et al. ..... 705/75

(Continued)

FOREIGN PATENT DOCUMENTS

EP 0651119 A 5/1995

(Continued)

OTHER PUBLICATIONS

Japanese Application No. 2002-548686; Office Action; Feb. 5, 2007.

(Continued)

*Primary Examiner*—Edwin C Holloway, III
(74) *Attorney, Agent, or Firm*—Cantor Colburn LLP

(57) ABSTRACT

A remote control system for operating a controllable unit includes a remote control device and a remotely-controlled device. A method for operating the remote control system includes the steps of transmitting a signal from the remote control device to the remotely-controlled device, transmitting a command signal from the remote control device to the remotely-controlled device, selectively transmitting an authorization request signal from the remotely-controlled device, transmitting a response signal from the remote control device to the remotely-controlled device, and verifying the response signal of the remote control device by the remotely-controlled device such that a controllable unit can be driven by the remotely-controlled device.

26 Claims, 3 Drawing Sheets

U.S. PATENT DOCUMENTS

| | | | | |
|---|---|---|---|---|
| 5,506,575 | A * | 4/1996 | Ormos | 340/5.23 |
| 5,517,187 | A | 5/1996 | Bruwer et al. | |
| 5,909,183 | A * | 6/1999 | Borgstahl et al. | 340/825.22 |
| 5,940,007 | A * | 8/1999 | Brinkmeyer et al. | 340/825.69 |
| 5,949,351 | A | 9/1999 | Hahm | |
| 5,986,571 | A * | 11/1999 | Flick | 340/825.72 |
| 6,124,804 | A | 9/2000 | Kitao et al. | |
| 6,154,544 | A | 11/2000 | Farris et al. | |
| 6,191,701 | B1 | 2/2001 | Bruwer | |
| 6,366,198 | B1 | 4/2002 | Allen et al. | |
| 6,377,173 | B1 | 4/2002 | Desai | |
| 6,441,719 | B1 | 8/2002 | Tsui | |

FOREIGN PATENT DOCUMENTS

| | | | |
|---|---|---|---|
| EP | 0803851 | A | 10/1997 |
| EP | 0908589 | A | 4/1999 |
| EP | 1052608 | A | 11/2000 |
| EP | 1340198 | B1 | 3/2005 |
| EP | 1548655 | A2 | 12/2005 |
| JP | 2288591 | | 11/1990 |
| JP | 3139996 | | 6/1991 |
| JP | 9049354 | | 2/1997 |
| JP | 9125768 | | 5/1997 |
| JP | 9215064 | | 8/1997 |
| JP | 9303019 | | 11/1997 |
| JP | 10088879 | | 4/1998 |
| JP | 10285666 | | 10/1998 |
| JP | 10-303886 | | 11/1998 |
| JP | 10303886 | | 11/1998 |
| JP | 2000270387 | | 9/2000 |
| KR | 164089 | | 12/1998 |
| WO | WO 9015211 | A | 2/1990 |

OTHER PUBLICATIONS

European Search Report, Jan. 30, 2006.

English language abstract of EP0908589, esn@cenet.com, Apr. 14, 1999.

English language abstract of EP0803851, esp@cenet.com, Oct. 29, 1997.

English translation of Korean Intellectual Property Office, Non-Final Rejection, Application No. 10-2003-7007702—issued Nov. 20, 2008—citing above Japanese and Korean References.

* cited by examiner

REMOTE CONTROL DEVICE AND METHOD OF CONFIGURATION OF SUCH A REMOTE CONTROL DEVICE

FIELD OF THE INVENTION

The present invention relates to a remote control device including a remote control unit and a remote-controlled unit, and a method of using the remote control device.

BACKGROUND OF THE INVENTION

In relation to remote control devices, it is commonly known to take steps to ensure that any given remote controlled unit may only be operated by a particular remote control unit and that, on the other hand, the activation of any such given remote control unit will not result in activation of (an)other remote-controlled unit or units than those intended.

Thus, it is known to provide a remote control with a code which is transmitted together with a command signal to the unit to be operated. The unit will know the code and upon receipt of the command signal, it will test whether the right code is transmitted and, if this is the case, carry out the desired command. This technique suffers from the drawback that it is possible to read and copy the transmitted command signals. Afterwards, it will be possible for an unauthorized person to transmit command signals with the correct code to one or more remote-controlled units, whereby such an unauthorized person will, e.g., gain access to a building through doors, gates or windows controlled by such a remote control.

A system of this kind is known from, e.g., German publication No, DE 197 33 405 A. 30 By this remote control system, it is also possible to enter a new code on the remote control, which is in the shape of a hand-held transmitter, and transfer the new code to the remote-controlled unit in such a manner that the remote-controlled unit will subsequently react when a command signal with this new code is transmitted. However, this known system still suffers from the above-mentioned drawback unless the chosen code is changed quite often, and in theory, each time a command signal is transmitted which is highly unlikely in practice.

Also, it is known to attach particular addresses to the remote-controlled units in question in cases where a remote control must be used to control more units independently of each other, and these addresses will subsequently form part of the transmitted command signals and result in selective control of the remote-controlled units.

Such a system is known from, e.g., WO 95/02231 A concerning a remote control for a lighting arrangement. By this system, it will also be possible to read and copy the transmitted control signals, after which unauthorized control signals may be transmitted.

A further related prior art system is described in EP 0 870 889 A2. This document relates to a keyless motor vehicle entry and ignition system, in which a number of remote controls may be used for selecting a function for the vehicle to perform, e.g., unlocking the doors, via coded signals. The vehicle comprises a microcomputer for controlling these functions, and this microcomputer contains a stored list of unique identification numbers for the remote controls, by which the vehicle may be controlled. Further, a unique seed number is allocated to the microprocessor, e.g., the vehicle, and this seed number must also be stored in a storage member of each remote control for controlling the vehicle. However, this prior art system is not suitable for a device comprising a plurality of remote-controlled units since, according to this prior art, a remote controlled unit must have knowledge of identification numbers or the like for the remote controls which may be used for controlling the units. Similarly, the addition or replacement of a remote control in such a prior art system will require a lot of effort since identification number(s) or the like will have to be amended, erased and/or added in all remote-controlled units controlled by the particular remote control(s).

BRIEF SUMMARY OF THE INVENTION

According to the present invention, a remote control device is provided with improved security. The component parts of the invention are simple, reliable, and economical to manufacture and use. Other advantages of the invention will be apparent from the following description and the attached drawings, or can be learned through practice of the invention.

Another purpose of the invention is to present a remote control device, which prevents the codes used by the device from being read and used for, e.g., unauthorized operation of the remote control device.

A further purpose of the invention is to provide a remote control device which is flexible with regard to the addition of remote-control units and/or remote controls while maintaining the standard of security.

Another purpose of the invention is to present a remote control device in which a remote controlled unit may easily be related to the device, and in which an already installed remote controlled unit may easily be replaced by another remote controlled unit. Additionally, one or more further remote controls may effortlessly be associated with the device, while simultaneously the high standard of security is maintained.

Yet another purpose of the invention is to present a method of configuration of a remote control device having the desired improved security.

Finally, another purpose of the invention is to present a method of configuration in which a remote control device prevents the codes used by the device from being read and used for, e.g., unauthorized operation of the remote control device.

The above-mentioned purposes are obtained via a remote control device for operation of at least one controllable unit such as a drive unit attached to a movable part such as a door, a gate, a window, blinds, shutters or a curtain, an awning or the like. In this aspect of the invention, the remote control device comprises a remote control unit and a remote-controlled unit designed in such a manner that the remote control unit can transmit coded control signals and the remote-controlled unit can receive and react upon the coded control signals. The remote control unit and the remote-controlled unit have one and the same code, and the remote-controlled unit can generate and transmit an authorization request signal upon receipt of a command signal from the remote control unit. Further, the remote control unit can generate and transmit a response signal to the authorization request. Finally, the remote-controlled unit can verify the response signal.

In the foregoing manner, security against maloperation and/or unauthorized operation is improved since the remote control unit will require confirmation of the command signal being sent from the correct remote control unit comprising the correct code, Since the completion of an operation requires correct verification of the remote-controlled unit's authorization request, which is controlled by verification in the remote-controlled unit, any attempt of unauthorized operation will require a significant effort and will be practically impossible since the invention will comprise a significant amount of variations in relation to both the authorization request and the required response signal from the remote control unit. Thus, various signal forms may be chosen, which vary in accordance with a pattern that cannot be deduced from the signals transmitted between the units. The codes stored in the units may furthermore not be detected by reading the transmitted signals since the form of the authorization requests and response signals is not known.

In a particularly advantageous embodiment, the remote-controlled unit is capable of generating and transmitting an authorization request signal, which can in turn generate random signals. Thus, the opportunity to synthesize a response signal to an authorization request signal will be practically non-existent since it will only be possible by systematic or non-systematic testing of numerous possibilities.

According to another embodiment, the remote control unit is capable of generating and transmitting a response signal to an authorization request signal, which carries out a coding of at least part of the information of the authorization request signal via its code. The remote-controlled unit can verify the response signal by carrying out a coding of at least part of the information in the authorization request signal by its own code and carries out a comparative procedure where these two coded signals are used.

Thus, the desired security is obtained in an advantageous manner, since no signals will be communicated that will inherently reveal any vital security information. Thus, the possibility of bystanders reading or copying such information is eliminated. If the code forms part of a signal when the units are communicating, it has been combined with a signal generated by the remote-controlled unit and such a signal will not be repeated but will vary from one operation procedure to another. Read communication signals will thus reveal neither the code nor the signal generated in the remote-controlled unit.

According to another embodiment, the remote-controlled unit encrypts the authorization request signal by the code in the remote-controlled unit, and the remote control unit encrypts the response signal by the code in the remote-controlled unit, such that additional security is obtained against maloperation and/or unauthorized operations.

According to another embodiment, the remote-controlled unit detects received non-critical command signals, and the remote-controlled unit is designed to comply with such non-critical command signals. Therefore, confirmation and subsequent verification will only be required in cases involving a critical command so that simplified control is obtained in relation to all other commands. Critical commands may be commands that effect opening of a door, a gate or a window leading into a building. Furthermore, it is possible to determine whether a command is critical or not depending on the time of day, e.g., opening of a window or a door may constitute an uncritical command if carried out on a working day during normal working hours but critical at all other times, The criterion for detection will be stored in the remote-controlled unit, e.g., in the form of identification of critical or non-critical commands, and possibly also in the form of time limits important in relation to detection. In the latter case, the remote control will furthermore comprise a time indicator, e.g., in the form of a watch and/or calendar function serving as reference.

In a further aspect of the invention, the remote control device may include one or more remote-controlled unit(s) in which each remote-controlled unit has a unique address, such that the respective remote-controlled units may be operated selectively by the remote control unit.

Further, the remote control device can have two or more remote control units in which each of the at least two or more remote control units has one and the same code, In this manner, it is possible to use several separate remote control units in the same system, e.g., by several different persons, and it will also be possible to keep remote control units in reserve if a remote control should disappear or malfunction.

Additionally, a remote control device according to another embodiment may have two or more remote-controlled units and at least one remote control unit in which addresses for the remote-controlled units are stored, the addresses being divided into one or more groups. In this manner, it will be possible to operate all units in the group at the same time which results in improved user-friendliness and extensive system flexibility.

The invention furthermore relates to a method for configuration of a remote control device designed to operate at least one remote-controlled unit such as a drive unit attached to a moveable part such as a door, a gate, a window, blinds, shutters, a curtain or an awning or the like. In this aspect, the remote control device has a remote control unit and a remote-controlled unit designed in such a manner that the remote control unit may transmit coded control signals, and the remote-controlled unit may receive and respond to the coded control signals. The method further provides one or more remote-controlled units each having an address; provision of a remote control unit being provided with a code; by an initiation command from the remote control unit initiating transmission of the respective addresses of one or more of the remote-controlled units, which are received and stored in the remote control unit; and by the code being transmitted to and stored by the remote-controlled unit(s) in question.

Accordingly, the remote control device will be configured in such a manner that all units to be operated by the remote control will transfer their respective addresses to the remote control, and a code, which is unique to the remote control, is simultaneously or subsequently transferred to the respective remote-controlled units so that it is subsequently possible to operate the remote control device in such a manner that it is optimally secured against maloperation and/or unauthorized operation.

In yet another aspect, the code will be stored by the remote-controlled units that have not previously been provided with a code, In this manner, it is possible to prevent previously configured units to be used in connection with a remote control system, e.g., a system in the immediate vicinity of the system to be configured and within communication-wise reach of the remote control unit forming part of the new system, from unintentionally being transferred to the new system.

The foregoing aspect may be obtained by the code being stored 5 by the respective remote-controlled units in such a manner that it cannot be replaced by a new configuration. Furthermore, the remote-controlled units may be designed in such a manner that once a code has been stored by a remote-controlled unit, such a unit will not be brought into a configuration state again if it receives an initiation command from a remote control unit, Thus, the unit will not transfer its address to the remote control unit and will therefore not be provided with any code by the remote control unit.

The data transferred during the initial configuration, and in particular the secret code, may be coded by a special master key. Therefore, the data and in particular the secret code is not accidentally and/or unintentionally be received and read by other that the intended receiver(s) during the initial configuration. Such a master key may be contained in and be identical and unique for equipment of a certain type, e.g., VELUX® remote control equipment, certain remote control equipment intended for special purposes, etc. This master key may be used only under special circumstances, e.g., for the initial configuration or for copying data from a master remote control to a new or slave remote control. By using this master key during special configuration processes, the security of the operation of the system according to the invention is enhanced.

According to another embodiment of the method, a group configuration of the remote control device is made, the remote control unit being brought in a programming state, and the one or more addresses stored in the remote control unit being attached to one of one or more user-specified groups. Thus, the opportunity to operate more units at the same time is obtained in a preferable manner, just as it becomes possible for the user to make such a division into groups in a manner which is completely adapted to the requirements of the user, which further improves user-friendliness and flexibility.

According to another embodiment of the invention, further additional steps may be carried out in which a code already stored by a remote-controlled unit may be removed by a reset procedure carried out on the remote-controlled unit prior to initiation of configuration of a remote control device in which the remote-controlled unit forms part or is to form part.

In the foregoing manner, a remote-controlled unit, which has previously been used by one remote control device and which is now to be used by a new device to be configured, or a remote-controlled unit in which a code has been stored by mistake, are brought into a state in which the code has been removed from the memory in such a manner that the remote-controlled unit may now form part of the configuration on equal terms with the other units. The reset procedure may be configured in such a manner that it will not be immediately possible for, e.g., unauthorized persons to carry out this procedure. For example, the procedure could be carried out inside the unit, or at least partly inside, so that the unit must be opened, an operating part placed on the unit may be activated in a particular manner or some kind of key may be used.

BRIEF DESCRIPTION OF THE DRAWINGS

Other aspects and advantages of the present invention will be apparent in the following detailed description with reference to the drawings in which.

DETAILED DESCRIPTION OF THE DRAWINGS

Figure 1:
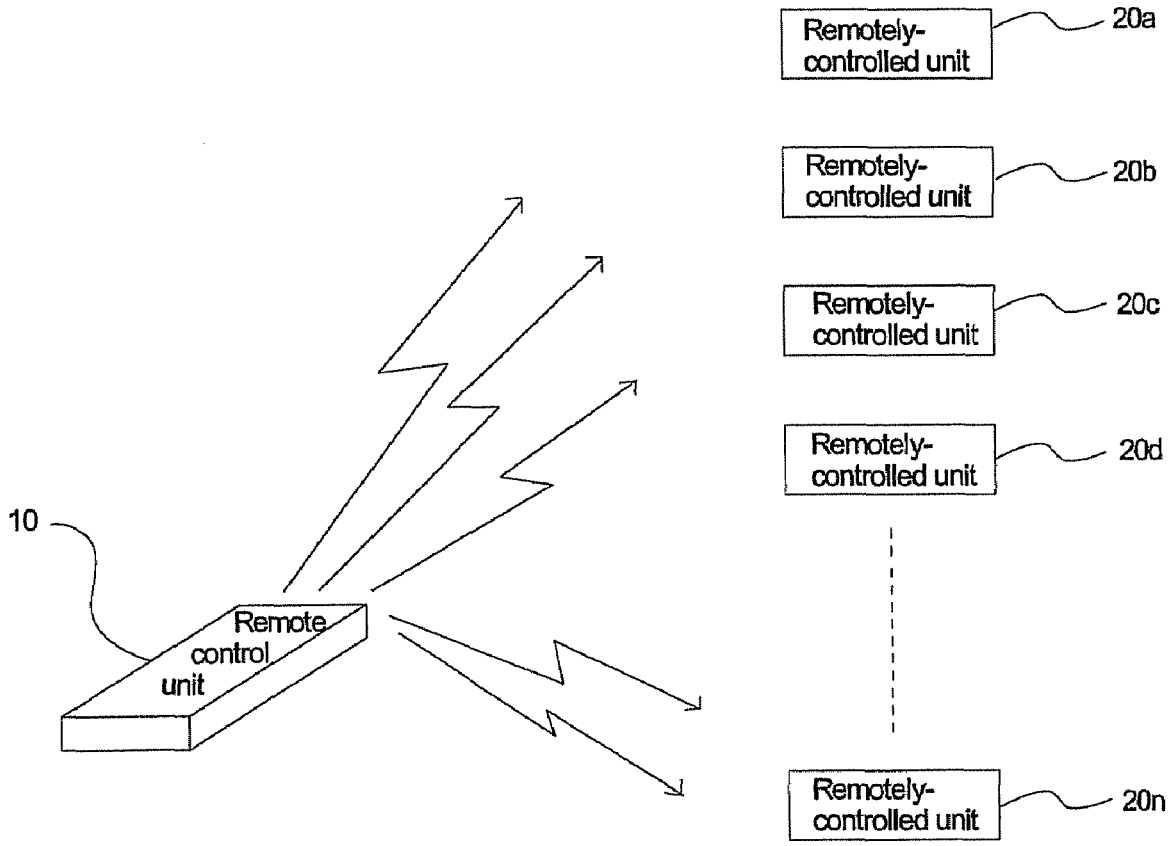
FIG. 1 is a simplified schematic view of a remote control device according to an embodiment of the invention.

Detailed reference will now be made to the drawings in which examples embodying the present invention are shown. Repeat use of reference characters in the present specification and drawings is intended to represent same or analogous features or elements of the invention.

The drawings and the following detailed description provide a full and detailed written description of the invention and the manner and process of making and using it, so as to enable one skilled in the pertinent art to make and use it. The drawings and detailed description also provide the best mode of carrying out the invention. However, the examples set forth herein are provided by way of explanation of the invention and are not meant as limitations of the invention. The present invention thus includes modifications and variations of the following examples as come within the scope of the amended claims and their equivalents.

FIG. 1 shows a remote control device according to an embodiment of the invention, the remote control device comprising a remote control unit 10, which also will be referred to as the remote control in the following, and a number of remote-controlled units 20*a*-20*n*. As will also appear from the following, one single remote-controlled unit may be involved, just as any number of remote-controlled units may be involved.

If a number of remote-controlled units 20*a*-20*n* is involved, these may be immediately and simultaneously accessible for operation by the remote control unit as illustrated or they may be individually operated. However, the remote-controlled units 20*a*-20*n* will often be divided into groups where all units in a group may be operated simultaneously.

Thus, the remote control unit 10 will comprise remote control buttons, operating keys or the like for selection of one or more units 20*a*-20*n* to be controlled. Likewise, the remote control unit 10 will select and/or program the parameters to be controlled.

Figure 2:
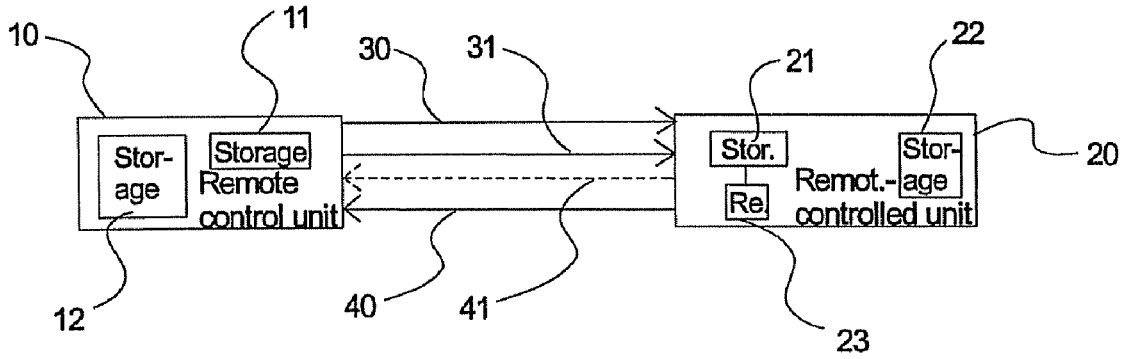
FIG. 2 is an initiation procedure at configuration of a remote control device according to another embodiment of the invention.

FIG. 2 shows how an initial configuration of the system takes place and includes installation of a code in connection with the installation of a remote control device according to an embodiment of the invention. When manufactured, the remote control 10 is provided with a secret code stored in a storage means 11 in the remote control 10. This code is unique for this remote control unit 10 and no other finished remote control has the same code.

By activation of an initiation procedure, the remote control 10 will transmit an initiation command by a signal 30 to all remote-controlled units 20 that are in proximity of the remote control 10 communication-wise, i.e., able to communicate with the remote control 10. If the remote-controlled units 20, (only one is illustrated in FIG. 2 for practical reasons) receiving the signal 30 have not previously been provided with a code, they will transmit a response signal 40 to the remote control unit 10. This response signal 40 is a confirmation to the remote control unit 10 and contains information in the form of an address which the remote-controlled unit 20 in question has stored in a storage means 22. This address has been assigned to the remote-controlled unit 20 during manufacture of the unit 20 and is unique to the unit 20 in question which means that two or more units 20*a*-20*n* will not have the same address.

The address is received by the remote control unit 10 and stored in an address storage means 12 together with the addresses of other remote-controlled units 20*a*-20*n* in the remote control device, which comprises the system of the remote control and the remote-controlled units controlled by the remote control. In addition to the address, the signal 40 may contain information of, e.g., the type of the remote-controlled unit 20, e.g. a door, a window, an awning, blinds etc., controlled by the remote-controlled unit 20. This information may also be stored in the address storage means 12 in the remote control 10 or in another storage device but in such a manner that the information may be coupled with the address in question.

Upon receipt and storage of an address and possibly other information of the remote-controlled unit(s) 20*a*-20*n* in question, the remote control unit 10 will transmit its secret code by a signal 31 to the respective unit(s) of the remote-controlled units 20*a*-20*n*, which have now been identified by the remote control 10 through their respective addresses. These units 20*a*-20*n* will each receive and store the code in question in a storage means 21 and potentially, as illustrated, each remote-controlled unit 20 may transmit a confirmation signal 41 back to the remote control unit 10.

To avoid accidentally and/or unintentionally permitting the secret code to be received and read by other that the intended receiver(s) during the initial configuration, the secret code may be coded by a special master key. This master key is contained in and is identical and unique for equipment of a certain type, e.g., VELUX® remote control equipment, certain remote control equipment intended for special purposes, etc. This master key is used only under special circumstances, e.g. for the initial configuration. By using this master key during initial configuration, the security of the operation of the system according to the invention is enhanced.

If, as previously mentioned, a code has already been stored in the storage means 21 of a remote-controlled unit 20, this unit will not respond to the transmitted signal 30 and the address of such a remote-controlled unit 20 will thus not be transferred to the 10 remote control unit 10.

In practice, the exchange of addresses and of the code may take place by the exchange of an address and of the code being completed between one remote-controlled unit 20 and the remote control unit 10 before carrying out the exchange between the following remote-controlled units 20 and the remote control unit 10. This initiation process may continue sequentially until the last of the remote-controlled units 20*a*-20*n* having received the initiation command 30 has transmitted its address and received the code. The sequence of configuration of the respective units 20*a*-20*n* may be determined in various ways and may, e.g., be determined by the units being susceptible to the initiation signal 30 at different time intervals, which may be mutually independent and potentially randomly divided between the units 20*a*-20*n*. The unit 20 with which the susceptible time interval and the initiation signal 30 first coincide will thus be configured first, etc.

The remote-controlled units 20 which have now stored the code will thus be remotely controlled only by the remote control 10 containing the same code as explained in greater detail below. The operation of the individual remote-controlled units 20*a*-20*n* by the remote control 10 can now principally be carried out, as will also be explained later.

As discussed above, a code from another remote control 10 cannot be transferred to a remote-controlled unit 20 which already has a code stored in its storage means 21 via the initiation procedure. This means that a code in a storage means 21 cannot be overwritten. Meanwhile, there may be cases where it must be possible to enter a new code, e.g., when using remote-controlled units 20*a*-20*n* which have been used by other remote control devices in connection with a new or other system group. By carrying out a special procedure, it is possible to reset or erase the storage means 21, e.g., by activating an operation button 23 that is not ordinarily accessible. An example of this may be removal of a top cover (not shown) or another action requiring intervention with the system, or by the operation button 23 being manipulated in a certain manner.

Figure 3:
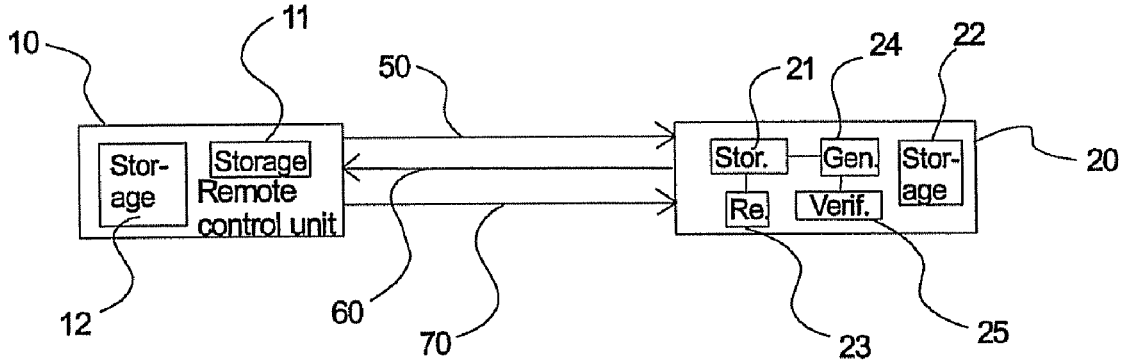
FIG. 3 illustrates a method of use of a remote control device according to a further embodiment of the invention.

The method of operation of the remote-controlled unit 20 will now be explained with reference to FIG. 3, which shows a remote control 10 and a remote-controlled unit 20 as in FIG. 2. It is to be understood that there may, of course, be more remote-controlled units 20*a*-20*n* to be controlled by the remote control 10.

On the remote control 10, a remote-controlled unit 20 or a group of remote-controlled units 20*a*-20*n* must be selected, explained below. A command, such as an action, a programming or the like, must also be carried out. A command signal 50 containing information of the address(es) of the chosen remote-controlled unit(s) and information of the command in question are transmitted from the remote control 10 to the remote-controlled units 20*a*-20*n*. They receive the command signal 50 and the remote-controlled unit(s) 20*a*-20*n* with the right address(es) will initiate further steps before the command can be completed. First and foremost, the remote-controlled unit(s) 20*a*-20*n* in question will decide upon previously determined criteria if the command in question is a command requiring authorization. If not, the command is carried out but if the command is a so-called critical command requiring authorization, the remote-controlled unit 20 will transmit a challenge signal in the form of an authorization request signal 60 to the remote control 10. A critical command may include a command which is of importance to security, e.g. the command may be one of opening doors, gates, or windows located in a so-called face wall of a building or the like.

This challenge signal 60 contains a sequence of digits comprising one or more random digits produced by a random generator 24. The challenge signal 60 is received by the remote control 10 in which a coding of at least part of the information of the challenge signal 60 by the code stored in the code storage means 11 of the remote control 10 will take place. The result will be returned to the remote-controlled unit 20 in the form of an authorization response 70. This is received by the remote-controlled unit 20, and the received authorization response 70, or at least a part thereof, is compared in a verification unit 25 to a signal produced by coding of the sequence of digits produced in the remote controlled unit 20 by the code stored in the storage means 21. If the two signals or rather corresponding parts of the two signals, for example the coded parts, are identical or concordant, the remote-controlled unit 20 will know for sure that the command is coming from the right remote control 10, or in other words, from the remote control 10 containing the same code as the remote-controlled unit 20.

As mentioned, the generated sequence of digits may be made by a random generator 24, but may also be made in other ways which will be obvious to a person skilled within the art. In any case, it should involve a sequence of digits which changes each time, The number of digits in the signal may be determined with respect to the desired security level and with respect to the equipment, available resources in the remote control, and/or the remote-controlled unit(s) 20*a*20*n* etc. The method of coding of the sequence of digits and/or signals comprising such a sequence by a code may be chosen from a variety of solutions which will be obvious to a person skilled within the art.

Also, as previously mentioned, the remote-controlled units 20 configured by a remote control unit 10 may be divided into groups to be controlled, i.e., operated simultaneously. This will be explained in the following with reference to FIG. 4, which shows an example of an embodiment of the remote control 10, in particular in relation to the operative embodiment.

As previously mentioned, the remote control 10 has a storage means 11 in which the code is stored, and a storage means 12 in which addresses and possibly the type of remote-controlled unit 20*a*-20*n*, which at the initiation procedure has received the code from the remote control 10, and is operated by this, have been stored.

Figure 4:
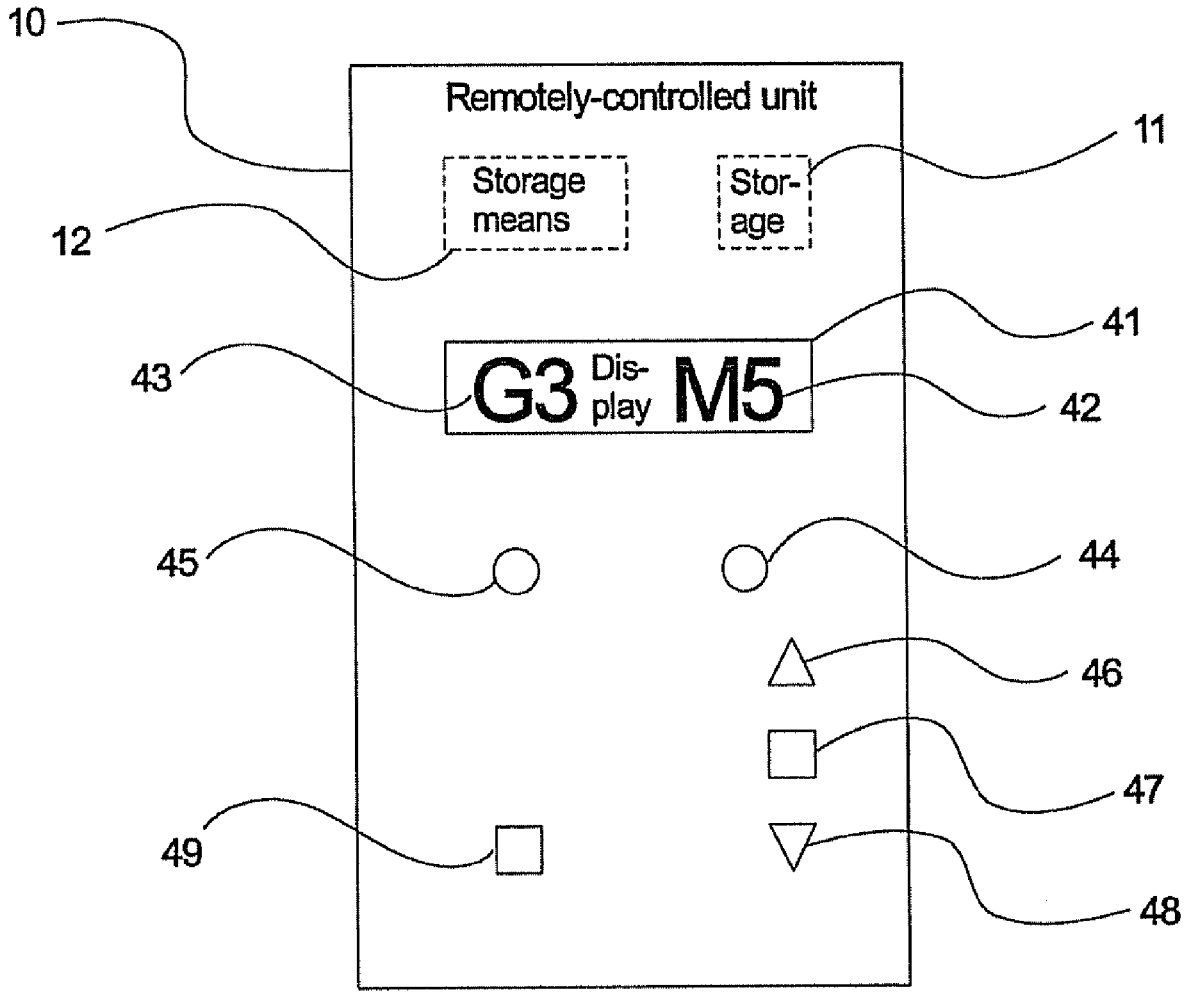
FIG. 4 is yet another embodiment of a remote control unit according to the invention.

Furthermore, the remote control 10 comprises the possibility of showing the remote-controlled unit(s) 20*a*-20*n* which may be controlled by the remote control 10. This is illustrated by a display 41 in FIG. 4. On the display 41, the identification 42 of a particular, chosen remote-controlled unit 20 has been shown as unit M5 in this example. Furthermore, FIG. 4 shows that the same display 41 may show the identification 43 of a particular chosen group, shown as unit G3 in this example. It will be obvious to a person skilled within the art that several other ways of indicating a chosen group and/or a selected remote-controlled unit than those illustrated may be chosen in practice.

In addition to the two identifications in 42 and 43, additional signalling means have been included, 44 and 45 respectively, which may, e.g., be visual indications such as light emitting diodes (LEDs) or other forms of signalling lamps. These signalling means 44, 45 may also be designed in such a manner that they may be used to select between group 43 and unit 42, e.g., in the form of push buttons or touch-sensitive keys.

Furthermore, the remote control 10 has been provided with a keyboard 46, 47, and 48 25 to be used when selecting groups and/or remote-controlled units 20*a*-20*n*, the keyboard further being used when controlling the remote-controlled units 20*a*-20*n*. This keyboard comprises a key 46 for increasing a displayed value, a key 48 for reducing a displayed value, and a key 47, a stop button, for selection of a shown value and potentially stopping an initiated increase or reduction of a parameter or another initiated command such as, e.g., initiated movement, e.g. opening of a window.

Finally, the remote control 10 has been provided with an operation button 49 to be used when initiating configurations of the remote control device. This operation button 49 may also be used to initiate the initiation procedure, which constitutes the initial configuration, since the button 49, when used for this purpose, may be operated in a special way or in a special combination with other keys for initiation of this rare, occurring procedure.

By configuration of the remote control device in groups, the remote control 10 must first be brought into a group configuration state. This may be done, for example, by activating the operation button 49, in a special manner, e.g., in combination with one or more other keys, in which unintended activation will be avoided. Hereafter, the group configuration may be carried out just as the composition of a group or more groups may be studied and potentially changed.

Firstly, activation of a selection of remote-controlled units 20*a*-20*n* is carried out, which may be done, for example, by the indicator/key 44. Once the selection of units has been activated, the indicator 44 will indicate this, e.g., by blinking. Hereafter, a selection of the various remote-controlled units may be made, e.g., M1-Mn corresponding to the units 20*a*-20*n*, by scrolling up and down by the buttons 46 and 48, respectively. Once a desired unit is displayed, e.g., a motor for opening/closing of a window, such as motor M5 as shown by 42, it may be selected by pressing the stop button 47. The indicator 44 can now indicate that a unit has been selected, e.g. by constant light. Furthermore, the remote control device will now indicate to the user which remote-controlled unit 20 has just been selected on the display 41 by activating the remote-controlled unit 20 in question for a brief period, or in another manner, indicate selection of the item. For example, a remote-controlled unit 20 which has been selected and relates to the operation of blinds or a window may briefly operate the blinds or open/close the window, respectively. In this manner, the user may determine where the selected units are actually located.

Hereafter, one or more groups G1-Gn may be chosen, in which it is desirable to include the selected unit. Selection and indication may, e.g., be made by the indicator 45, which will now be active, either by constant light or by blinking. As was the case above with the selection of unit, it is possible to scroll up and down by using the keys 46 and 48. If a group shown on the display 41 already includes the unit in question, the indicator 45 will indicate this by, e.g., blinking. If the remote-controlled unit shown on display 41 is not part of the group, the indicator will also indicate this by e.g. constant light.

If the previously selected unit, e.g., the unit with identification M5 as shown by 42, should be included in the now selected group, e.g. group G3 as shown by 43, this may e.g. be done by activating the stop button 47, after which the indicator 45 will blink and indicate that the previously selected unit has now been transferred to the selected group. If a selected unit already included in the group in question should be removed from the group, this may also be done by activating the stop button 47, after which the indicator 45 will indicate that the unit is removed from the group by constant light.

Correspondingly, other groups may be examined for the unit in question when configuring the group relations, and a new remote-controlled unit 20 may subsequently be chosen as described above, after which a corresponding process may be carried out.

It is of course possible to create groups according to specific requirements, and it will also be possible to include the same remote-controlled unit 20*a*-20*n* in more than one group, if necessary. As an example, a group creation consisting of 4 groups, G1-G4 may be imagined from FIG. 1 in which, G1 comprises the remote-controlled units 20*b*, 20*c*, and 20*e*, group G2 comprises the units 20*a*, 20*c*, 20*d*, 20*g* and 20*h*, group G3 comprises the units 20*f*, 20*i*, 20*j*, 20*m*, and 20*n*, and group G4 comprises the units 20*k* and 20*l*.

The procedure for group creation may be determined in other ways than described above. For instance, it is possible to select one of the remote-controlled units, and its relations to one or more groups may be created, shown and/or changed. Furthermore, the remote control 10 may be designed in several different ways and by use of a many different options, which will be obvious to a man skilled within the art, For example, the display 41 may be designed to show additional information concerning units 42 and/or groups 43, e.g. user-entered information concerning nature and/or location of a unit etc. Furthermore, the remote control 10 may be designed with additional keyboards, e.g. an alpha-numerical keyboard to be used for inputting and so forth.

As previously mentioned, the codes included in the individual remote controls 10 are unique in which one and only one remote control 10 may be used to control a system. This is the remote control 10 which has been used at the initiation procedure. Since it may be practical to have more than one remote control 10 for a remote control system, e.g., a remote control system of a large building or in a place where more persons need to carry out operations independently of each other, and since it may be practical and/or necessary to have remote controls 10 in reserve at hand if the original one has been misplaced, destroyed or in another manner deactivated, it will be possible to copy the first code, that is the original code, from the original remote control to any other remote control 10. This takes place by bringing the two remote controls into contact with each other communication-wise and by carrying out a special command, e.g. a key combination or by pressing one key of one of the remote controls (the original remote control or the master remote control) and potentially also include the new remote control (the slave remote control), whereby the code is transferred to the storage means 11 of the new remote control. At the same time, addresses and groups stored in the address storage means 12 are also transmitted to and stored by the new remote control. The initial code of the new remote control may be maintained therein but will be inactive.

In order to avoid that the transferred data, e.g., in particular the secret code is accidentally and/or unintentionally received and read by other than the intended receiver, e.g. the new remote control, the data may be coded during this data transmission by the previously mentioned master key, which is unique for the type of equipment used, e.g. VELUX® remote control equipment, certain remote control equipment intended for special purposes, etc. As mentioned above this master key is used only under special circumstances, e.g. for the initial configuration. By using this master key during this copy-process the security of the operation of the system according to the invention is enhanced.

If one of the remote controls 10 has disappeared in a manner which causes concern in 10 relation to security, the original code must be removed from all remote-controlled units. As explained above, this is done by manipulation of the command key 23 (FIG. 3). Subsequently, one of the original slave remote controls in which the original code is maintained as described above may be used to initiate the initiation procedure whereby its code, which is new in relation to the system, will be transferred to all remote-controlled units 20*a*-20*n* with no code. This slave remote control, which is now the master control will, however, still comprise its original group configuration which may be transferred to the other slave remote controls together with the new master code as described above.

In the above, communication between the included units has not been described in detail and it should be understood that communication may take place in any form suitable, i.e. by infrared communication, ultrasound communication, electromagnetic communication and the like. Furthermore, the remote control 10 is illustrated in relation to doors, gates, windows and various kinds of light opening covers but it should be understood that numerous other fields of application where there is a need for operation of one or more elements that do not necessarily have any movable parts, at a distance, selectively and/or in any other manner, are also possible. Finally, it should be noted that the included remote control units 10 do not necessarily have to be designed as hand-held transmitters but may also be designed as stationary units or mobile units that may even be designed in such a manner that they may be placed stationary, or in any other manner known or obvious to a person skilled within the art.

Thus, while exemplary embodiments of the invention have been shown and described, those skilled in the art will recognize that other changes and modifications may be made to the foregoing examples without departing from the scope and spirit of the invention. For instance, specific shapes of various elements of the illustrated embodiments may be altered to suit particular applications. It is intended to claim all such changes and modifications as fall within the scope of the appended claims and their equivalents.

The invention claimed is:

1. A method for operating a remote control system, the method comprising the steps of:

transmitting a signal from a remote control device having a unique code, the signal selected from the group consisting of an initiation signal, a signal comprising said unique code, and combinations thereof;

receiving the signal by a remotely-controlled device in communication with the remote control device, the remotely-controlled device having a unique address and being configured to selectively react to the signal by sending said unique address to the remote control device to receive the signal comprising said unique code from the remote control device and store said unique code in a code storage in case said signal is an initiation signal and said code storage is void of a code, and to await a command signal from the remote control device in case said code storage contains a code;

transmitting a command signal from the remote control device to the reactive remotely-controlled device, said command signal comprising the unique address;

selectively transmitting an authorization request signal from the reactive remotely-controlled device responsive to the command signal of the remote control device;

transmitting a response signal from the remote control device in response to the authorization request signal of the remotely-controlled device, said response signal being generated using said unique code; and verifying the response signal from the remote control device by the remotely-controlled device to drive a controllable unit by the remotely-controlled device, said response signal being verified by generating a further coded signal using said unique code and by carrying out a comparative procedure of the response signal and said further coded signal.

2. The method of claim 1, further comprising the step of storing a unique address of the remotely-controlled device in the remote control device.

3. The method of claim 1, further comprising the step of transmitting the authorization request signal from the remotely-controlled device when the command signal is a critical command.

4. The method of claim 1, further comprising the step of producing random digits to define the authorization request signal.

5. The method of claim 1, further comprising the step by the remote control device of defining the response signal by recoding at least a portion of the authorization request signal.

6. The method of claim 1, further comprising the step by the remotely-controlled device of driving the controllable unit, the controllable unit selected from the group consisting of a door, a gate, a window, a blind, a shutter, a curtain, an awning, and combinations thereof.

7. A method for operating a remote control system for moving a moveable part, the method comprising an initial configuration procedure comprising the steps of:

providing a remotely-controlled device having a unique address; providing a remote control device having a unique code;

initiating an initiation command from the remote control device; and selectively transmitting the unique address from the remotely-controlled device to the remote control device, when the remotely-controlled device defines no stored code;

receiving and storing in the remote control device the unique address transmitted by the remotely-controlled device;

transmitting the unique code from the remote control device to the remotely-controlled device; and storing the unique code in the remotely-controlled device.

8. The method as in claim 7, wherein the remotely-controlled device is a plurality of remotely-controlled units and further comprising the steps of dividing the plurality of remotely-controlled units into a plurality of groups, storing respective unique addresses for each group in the remote control device, and selectively programming at least one of the groups by the remote control device.

9. The method as in claim 7, further comprising the step of preventing the code stored by the remotely-controlled device from being overwritten by a new configuration.

10. The method as in claim 7, further comprising the step of resetting the code stored in the remotely-controlled device.

11. The method as in claim 7, further comprising the step of transmitting the code and the unique address by one of infrared communication, ultrasonic communication, electromagnetic communication and combinations thereof.

12. A remote control system for operating a drive unit, the remote control system comprising:

a remote control device having a unique code, the remote control device configured to transmit a signal selected from the group consisting of an initiation signal, a signal comprising said unique code, and combinations thereof;

a remotely-controlled device in communication with the remote control device, the remotely-controlled device having a unique address and being configured to receive and react to the signal by transmitting a unique address to receive the signal comprising said unique code from the remote control device and store said unique code in a code storage means, in case said signal is an initiation signal and said code storage means is void of a code, and to await a command signal from the remote control device, in case said code storage means contains a code, said command signal comprising the unique address;

the remotely-controlled device further including means for selectively generating and transmitting an authorization request signal based on the command signal;

the remote control device further including means for generating and transmitting a response signal in response to the authorization request signal, said response signal being generated using said unique code; and the remotely-controlled device further including means for verifying the response signal such that a controllable unit is moved by the remote-controlled unit, said means for verifying the response signal being adapted for generating a further coded signal using said unique code and for carrying out a comparative procedure of the response signal and said further coded signal.

13. The remote control system of claim 12, wherein the remote control device is a plurality of remote control units each comprising said unique code and having the same signal.

14. The remote control system of claim 12, wherein the remotely-controlled device is a plurality of remotely-controlled units each having a unique address selectively responsive to the signal of the remote control device.

15. The remote control system of claim 12, wherein the command signal is a critical command.

16. The remote control system of claim 15, wherein the remotely-controlled device includes means for detecting whether the command signal is critical and further configured to comply with a non-critical command signal without generating and transmitting the authorization request signal.

17. A remote control system for operating a drive unit, the remote control system comprising:

a remote control device having a unique code, the remote control device configured to transmit a signal selected from the group consisting of an initiation signal, a signal comprising said unique code, and combinations thereof; and a remotely-controlled device in communication with the remote control device, the remotely-controlled device having a unique address and being configured to react to the initiation signal by transmitting said unique address to receive the signal comprising said unique code from the remote control device and store said unique code in a code storage means, in case said signal is an initiation signal and said code storage means is void of a code, and to await a command signal from the remote control device in case said code storage means contains a code, said command signal comprising the unique address, the remotely-controlled device further configured to selectively generate and transmit an authorization request signal in response to the command signal, the remote control device configured to transmit a response signal in response to the authorization request signal, said response signal being generated using said unique code, the remotely-controlled device further configured to verify the response signal by generating a further coded signal using said unique code and for carrying out a comparative procedure of the response signal and said further coded signal to move a controllable unit.

18. The remote control system of claim 17, wherein the remote control device is a plurality of remote control units each comprising said unique code, which is unique to said remote control device, and configured with the same signal.

19. The remote control system of claim 17, wherein the remotely-controlled device is a plurality of remotely-controlled units each having a unique address selectively responsive to the signal of the remote control device.

20. The remote control system of claim 17, wherein the remote control device includes a key configured for coding the signal comprising said unique code.

21. The remote control system of claim 17, wherein the command signal is a critical command prompting the authorization request signal before the controllable unit is moved.

22. The remote control system of claim 17, wherein the remotely-controlled device is further configured to detect whether the command signal is critical and further configured to comply with a non-critical command signal without generating and transmitting the authorization signal.

23. The remote control system of claim 17, further including a random generator configured to produce random digits in the authorization request signal.

24. The remote control system of claim 17, wherein the remotely-controlled device further includes a verification unit for verifying the response signal.

25. A method for operating a remote control system, the method comprising the steps of:

transmitting a signal from a remote control device having a unique code, the signal selected from the group consisting of an initiation signal, a signal comprising said unique code, and combinations thereof;

receiving the signal by a remotely-controlled device in communication with the remote control device, the remotely-controlled device having a unique address and being configured to selectively react to the signal by sending said unique address to the remote control device to receive the signal comprising said unique code from the remote control device and store said unique code in a code storage in case said signal is an initiation signal and said code storage is void of a code, wherein when void said unique code is received and stored without any additional manipulation of the remotely-controlled unit, and to await a command signal from the remote control device in case said code storage contains a code;

transmitting a command signal from the remote control device to the reactive remotely-controlled device, said command signal comprising the unique address;

selectively transmitting an authorization request signal from the reactive remotely-controlled device responsive to the command signal of the remote control device;

transmitting a response signal from the remote control device in response to the authorization request signal of the remotely-controlled device, said response signal being generated using said unique code; and verifying the response signal from the remote control device by the remotely-controlled device to drive a controllable unit by the remotely-controlled device, said response signal being verified by generating a further coded signal using said unique code and by carrying out a comparative procedure of the response signal and said further coded signal.

26. The method according to claim 25, wherein said unique code is unique in that at any time only a single code can be actively used by the remote control device.

* * * * *